US009945547B2

(12) United States Patent
Farrnbacher et al.

(10) Patent No.: US 9,945,547 B2
(45) Date of Patent: Apr. 17, 2018

(54) ILLUMINANT WITH PLUG-TYPE CONNECTION

(71) Applicant: OSRAM OLED GmbH, Regensburg (DE)

(72) Inventors: Joerg Farrnbacher, Regensburg (DE); Stefan Gschloessl, Nittendorf (DE); Kilian Regau, Regensburg (DE); Karsten Diekmann, Rattenberg (DE); Christian Kristukat, Buenes Aires (AR)

(73) Assignee: OSRAM OLED GMBH, Regensburg (DE)

( * ) Notice: Subject to any disclaimer, the term of this patent is extended or adjusted under 35 U.S.C. 154(b) by 0 days.

(21) Appl. No.: 14/763,173

(22) PCT Filed: Dec. 23, 2013

(86) PCT No.: PCT/EP2013/077920
§ 371 (c)(1),
(2) Date: Jul. 24, 2015

(87) PCT Pub. No.: WO2014/114419
PCT Pub. Date: Jul. 31, 2014

(65) Prior Publication Data

US 2015/0354801 A1 Dec. 10, 2015

(30) Foreign Application Priority Data

Jan. 25, 2013 (DE) ..... 10 2013 201 219

(51) Int. Cl.
*F21S 4/00* (2016.01)
*F21V 23/06* (2006.01)
(Continued)

(52) U.S. Cl.
CPC ..... *F21V 23/06* (2013.01); *F21V 19/0015* (2013.01); *F21Y 2105/00* (2013.01);
(Continued)

(58) Field of Classification Search
CPC . F21V 23/06; F21V 19/0015; F21Y 2105/008
(Continued)

(56) References Cited

U.S. PATENT DOCUMENTS 6,411,022 B1 * 6/2002 Machida ..... B60Q 1/2696 313/318.1
7,064,674 B2 * 6/2006 Pederson ..... B60Q 1/2611 340/321
(Continued)

FOREIGN PATENT DOCUMENTS

CN 101675707 A 3/2010
DE 102008034956 A1 2/2010
(Continued)

OTHER PUBLICATIONS

German Search Report based on Application No. 10 2013 201 219.5 (5 Pages) dated Aug. 22, 2013 (Reference Purpose Only).
(Continued)

*Primary Examiner* — Bryon T Gyllstrom
(74) *Attorney, Agent, or Firm* — Viering, Jentschura & Partner mbB

(57) ABSTRACT

An illuminant may include at least one light-emitting element unit, which has a carrier, at least one light-emitting element arranged on the carrier and is surrounded by an encapsulating material, at least one contact area formed on the carrier, and at least one contact element arranged on the contact area, wherein the light-emitting element surrounded by the encapsulating material is electrically connected to the contact element via the contact area, and at least one mating contact element, wherein electrical contact can be made
(Continued)

between the mating contact element and the contact element via a plug-type connection, wherein the contact element is a female connector element, and the mating contact element is a male connector element and having a plurality of pin contact elements, or the contact element is a male connector element and having a plurality of pin contact elements, and the mating contact element is a female connector element.

20 Claims, 3 Drawing Sheets

(51) Int. Cl.

| | |
|---|---|
| ***F21V 19/00*** | (2006.01) |
| *F21Y 105/00* | (2016.01) |
| *F21Y 105/10* | (2016.01) |
| *F21Y 115/10* | (2016.01) |
| *F21Y 115/15* | (2016.01) |

(52) U.S. Cl.
CPC ..... *F21Y 2105/10* (2016.08); *F21Y 2115/10* (2016.08); *F21Y 2115/15* (2016.08)

(58) Field of Classification Search
USPC ..... 362/249.01
See application file for complete search history.

(56) References Cited

U.S. PATENT DOCUMENTS

| | | | | |
|---|---|---|---|---|
| 7,201,511 | B2 * | 4/2007 | Moriyama | F21K 9/00 257/668 |
| 7,280,288 | B2 * | 10/2007 | Loh | G02B 3/00 257/E33.073 |
| 7,566,147 | B2 * | 7/2009 | Wilcox | F21V 15/01 362/240 |
| 7,622,795 | B2 * | 11/2009 | Chiang | F21K 9/00 257/100 |
| 7,641,379 | B2 * | 1/2010 | Gisler | H01R 12/585 361/807 |
| 7,815,339 | B2 * | 10/2010 | Veenstra | F21K 9/13 362/249.02 |
| 2002/0113244 | A1 * | 8/2002 | Barnett | F21S 4/28 257/98 |
| 2003/0112627 | A1 * | 6/2003 | Deese | F21V 21/0832 362/249.01 |
| 2005/0225985 | A1 * | 10/2005 | Catalano | H05B 33/0809 362/277 |
| 2008/0253120 | A1 * | 10/2008 | Okimura | B41J 2/45 362/249.01 |
| 2010/0149808 | A1 | 6/2010 | Huber et al. | |
| 2011/0116275 | A1 * | 5/2011 | Sheek | H01R 12/592 362/382 |
| 2011/0193484 | A1 | 8/2011 | Harbers et al. | |
| 2012/0104976 | A1 * | 5/2012 | Snijder | F21S 2/005 315/312 |
| 2012/0311857 | A1 | 12/2012 | Kampfrath et al. | |
| 2013/0141913 | A1 * | 6/2013 | Sachsenweger | F21V 29/77 362/249.02 |

FOREIGN PATENT DOCUMENTS

| | | | |
|---|---|---|---|
| DE | 102009054511 | A1 | 6/2011 |
| DE | 202012001835 | U1 | 3/2012 |
| DE | 202011101663 | U1 | 8/2012 |
| DE | 102011075161 | A1 | 11/2012 |
| KR | 200448368 | Y1 | 4/2010 |
| WO | 9906759 | A1 | 2/1999 |
| WO | 2012020013 | A1 | 2/2012 |
| WO | 2012096676 | A1 | 7/2012 |

OTHER PUBLICATIONS

International Search Report based on Application No. PCT/EP2013/077920 (4 pages) dated Mar. 26, 2014 (for reference purpose only).
Chinese Office Action based on application No. 201380071262.0 (7 pages and 8 pages of English translation) dated Jul. 4, 2017 (Reference Purpose Only).

* cited by examiner

ILLUMINANT WITH PLUG-TYPE CONNECTION

RELATED APPLICATIONS

The present application is a national stage entry according to 35 U.S.C. § 371 of PCT application No.: PCT/EP2013/077920 filed on Dec. 23, 2013, which claims priority from German application No.: 10 2013 201 219.5 filed on Jan. 25, 2013, and is incorporated herein by reference in its entirety.

TECHNICAL FIELD

Various embodiments may relate to an illuminant.

BACKGROUND

Such an illuminant can be in the form of a light-emitting module or a light-emitting panel, for example. Illuminants usually have one or more light-emitting element units, which have one or more light-emitting elements surrounded by an encapsulating material, which are arranged on a carrier, for example a substrate, which in turn has one or more contact areas. A formation of an electrical contact of the light-emitting element unit usually takes place directly via an arrangement of spring pins, application of a conductive adhesive or a conductive paste or use of a crimped connection. Furthermore, it is also possible to use ACF-bonded printed circuit boards (ACF: anisotropic conductive film), which have a solderable metallic area for soldering further contact elements. Such contacts are, however, complex to manufacture and usually inflexible since they cannot be detached from one another and reconnected to one another a plurality of times.

SUMMARY

Various embodiments provide an illuminant in which the formation of an electrical contact may be performed with reduced complexity and, in addition, the electrical contact may be more flexible.

In various embodiments, an illuminant may include: at least one light-emitting element unit, which has a carrier, at least one light-emitting element, which is arranged on the carrier and is surrounded by an encapsulating material, at least one contact area formed on the carrier, and at least one contact element arranged on the contact area, wherein the light-emitting element surrounded by the encapsulating material is electrically connected to the contact element via the contact area, and at least one mating contact element, wherein electrical contact may be made between the mating contact element and the contact element via a plug-type connection.

Such illuminants may be formed from one or more light-emitting element units. A light-emitting element unit may in turn have one or more light-emitting elements surrounded by an encapsulating material, wherein the light-emitting elements may be, for example, light-emitting diodes (LEDs) or organic light-emitting diodes (OLEDs). In order to form an electrical contact, the light-emitting element unit has one or more contact elements, wherein these contact elements may be detachably connected to a mating contact element in order to form an electrical connection or contact here as well. The contact element and the mating contact element may be connected to one another via a plug-type connection. The plug-type connection enables simple handling so as to form an electrical contact so that the electrical contact may be made without any considerable complexity being involved. In addition, the plug-type connection makes it possible for the contact element and the mating contact element to also be transferred a plurality of times from a (mechanically and/or electrically conductively) connected state into a (mechanically and/or electrically conductively) non-connected state, and vice versa, so that the formation of an electrical contact is flexible and may thus be used a plurality of times.

The at least one light-emitting element may have at least one light-emitting semiconductor element.

For example, it is possible for the contact element to be a female connector element (for example a female connector in the form of a first plug-type connector part) and for the mating contact element to be a male connector element (for example a male connector in the form of a second plug-type connector part) or for the contact element to be a male connector element and for the mating contact element to be a female connector element. The female connector element may have one or more openings for receiving the male connector element, wherein, in the case of a plurality of openings, the female connector element may be in the form of a female connector strip. The male connector element may have one or more pin contact elements, which may each be inserted into an opening in the female connector element so as to form the electrical connection between the female connector element and the male connector element, wherein the male connector element may be referred to as a male connector strip when said male connector element has a plurality of pin contact elements. By virtue of the formation of a plug-type connection by a female connector element and a male connector element, a plug-type connection with a small physical height may be formed. In addition, such a plug-type connection element is characterized by simple handling.

The contact element may be electrically connected to the contact area directly via a cohesive connection. The cohesive connection may be formed, for example, by bonding, soldering, welding or adhesive bonding, as a result of which a secure and stable connection may be formed between the contact element and the contact area, which connection additionally does not negatively influence the physical height of a light-emitting element unit and therefore also the illuminant. Here, directly means that a further component is optionally arranged between the contact element and the contact area by the cohesive connection.

Alternatively, however, it is also possible for the contact element to be electrically connected to the contact area via a printed circuit board. The contact element may then be fixedly connected to the printed circuit board via a soldered connection, for example. The printed circuit board makes it possible that, for example, even a plurality of contact elements may be arranged next to one another on one or more contact areas arranged next to one another via the printed circuit board.

The printed circuit board may be a flexible printed circuit board, which is characterized by a particularly small physical height and a small space requirement.

To secure the connection between the mating contact element and the contact element against undesired detachment, it is possible, for example, for the mating contact element to be detachably latchable on the contact element via at least one fastening element. The fastening element, which is a latching element, for example, and enables mechanical fastening between the contact element and the mating contact element, may be formed in such a way that it is only detachable by means of a tool. For example, the fastening element may be in the form of one or more latching lugs or barbs.

The illuminant may furthermore be designed in such a way that a mating contact element makes electrical contact with two or more contact elements. The mating contact element may thus span two or more contact elements, wherein, as a result, two or more light-emitting element units may also be brought into electrically conductive contact with a mating contact element. The formation of an electrical contact in the case of a plurality of light-emitting element units of an illuminant may thus take place more quickly and with less complexity involved. In addition, the number of mating contact elements required may be reduced, as a result of which the entire illuminant may be designed to be more compact.

It is further possible for a plurality of mating contact elements to be fastened on a carrier plate and for the plurality of mating contact elements to be electrically contactable with a plurality of contact elements. By virtue of this formation, a plurality of light-emitting element units may be arranged next to one another in a row in a particularly compact manner by virtue of said light-emitting element units being combined to form blocks, for example, in order to form an illuminant. The carrier plate may be in the form of a printed circuit board or else in the form of a frame on which the mating contact elements rest, for example, in order to increase stability.

Furthermore, it is also possible to design a connection between two light-emitting element units arranged next to one another of an illuminant to be compact and direct by virtue of a contact element of a first light-emitting element unit being integrally connected to a mating contact element, which may be brought into electrical contact with a contact element of a second light-emitting element unit, via a connecting region.

The mating contact element may be connected to a power supply line, for example by a cable. Furthermore, however, it is also possible for a first mating contact element, which is connected to a contact element of a first light-emitting element unit, to be connected to a second mating contact element, which is connected to a contact element of a second light-emitting element unit, via suitable conductor elements, such as, for example, a cable, in order to connect two light-emitting element units. In addition, the mating contact element may be soldered to a printed circuit board and thus electrically conductively connected to the printed circuit board and to further mating contact elements via conductor tracks. This may take place, for example, by MID (molded interconnect device) technology.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the detailed description below, reference is made to the attached drawings, which form part of this description and which, for illustrative purposes, show specific embodiments in which the invention can be implemented. In this regard, directional terminology such as, for example, "at the top", "at the bottom", "at the front", "at the rear", "front", "rear", etc. is used with reference to the orientation of the figure(s) described. Since components of embodiments can be positioned in a number of different orientations, the directional terminology is used for illustrative purposes and is in no way restrictive. It goes without saying that other embodiments can be used and structural or logical amendments made without departing from the scope of protection of the present invention. It goes without saying that the features of the various exemplary embodiments described herein can be combined with one another, where not specified otherwise. The following detailed description should therefore not be interpreted in a restrictive sense, and the scope of protection of the present invention is defined by the attached claims.

Within the scope of this description, the terms "connected" and "coupled" are used to describe both a direct and an indirect connection, and a direct or indirect coupling. Identical or similar elements are provided with identical reference symbols in the figures, insofar as this is expedient.

Figure 1:
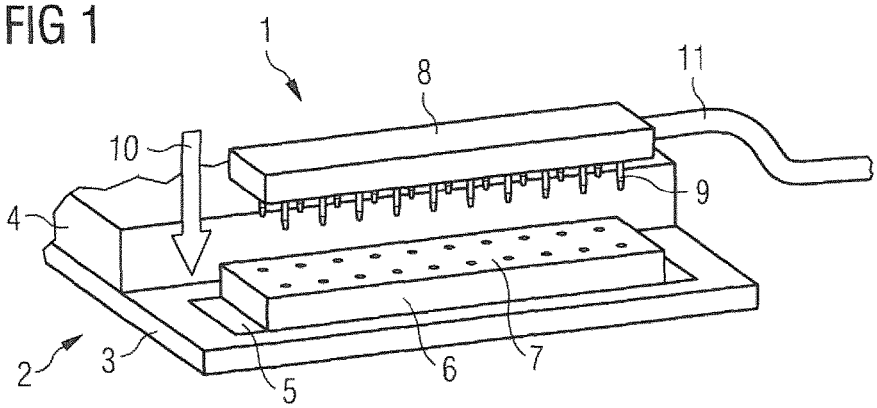
FIG. 1 shows a schematic illustration of an illuminant in accordance with one embodiment.

FIG. 1 shows an illuminant 1 in the form of a light-emitting panel, said illuminant having a light-emitting element unit 2 in the form of at least one contact strip and a carrier element 3, on which one or more contact areas and a light-emitting semiconductor element are arranged, wherein contact is made with the light-emitting semiconductor element via one or more contact areas of the carrier element 3. The light-emitting semiconductor element is surrounded by an encapsulating material 4 in order to protect the light-emitting semiconductor element from environmental influences. Furthermore, a printed circuit board 5 is arranged on one of the one or more contact areas, with in turn a contact element 6 being arranged on said printed circuit board, wherein the contact element 6 is in this case in the form of a female connector element, in particular a female connector strip, which has a plurality of openings 7. The light-emitting semiconductor element is connected electrically to the contact element 6 via the carrier element 3, the one or more contact areas and the printed circuit board 5.

The illuminant 1 furthermore has a mating contact element 8, which in this case is in the form of a male connector element in the form of a male connector strip and has a multiplicity of pin contacts 9, which may each be inserted into an opening 7 in the contact element 6 so as to form an electrical contact between the contact element 6 and the mating contact element 8. The contact element 6 and the mating contact element 8 may therefore be brought into electrical contact with one another via a plug-type connection. The directional arrow 10 shows the movement of the mating contact element 8 in the direction of the contact element 6 so as to form the plug-type connection and therefore electrical contact. The mating contact element 8 is connected to a power supply line via a cable 11.

Figure 2:
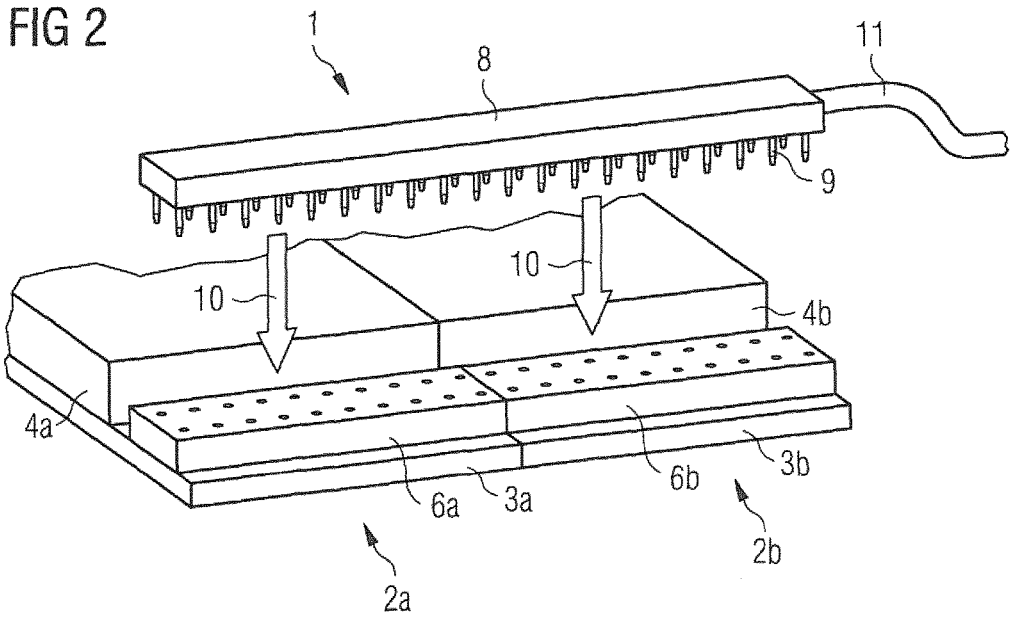
FIG. 2 shows a schematic illustration of an illuminant in accordance with a further embodiment.

FIG. 2 shows a further embodiment of an illuminant 1, wherein the illuminant 1 may have two or more light-emitting element units 2*a*, 2*b*. Each light-emitting element unit 2*a*, 2*b* has in each case one carrier 3*a*, 3*b*, a light-emitting semiconductor element surrounded by an encapsulating material 4*a*, 4*b* and a contact area, on which a contact element 6*a*, 6*b* in the form of a female connector element is arranged, wherein the contact element 6*a*, 6*b* is in this case arranged directly on the contact area and is electrically connected to the contact area via a cohesive connection, formed by adhesive bonding, bonding, soldering or welding. In addition, the illuminant 1 has a mating contact element 8 in the form of a male connector element, wherein the mating contact element 8 is formed so as to be so long that it can be plugged into the two contact elements 6*a*, 6*b* of the two light-emitting element units 2*a*, 2*b*, with the result that two light-emitting element units 2*a*, 2*b* can be connected to one another via one mating contact element 8. In this case too, a cable 11 may be arranged on the mating contact element 8, it being possible for said cable to be connected to a power supply line or else to a further mating contact element 8, not shown here.

Figure 3:
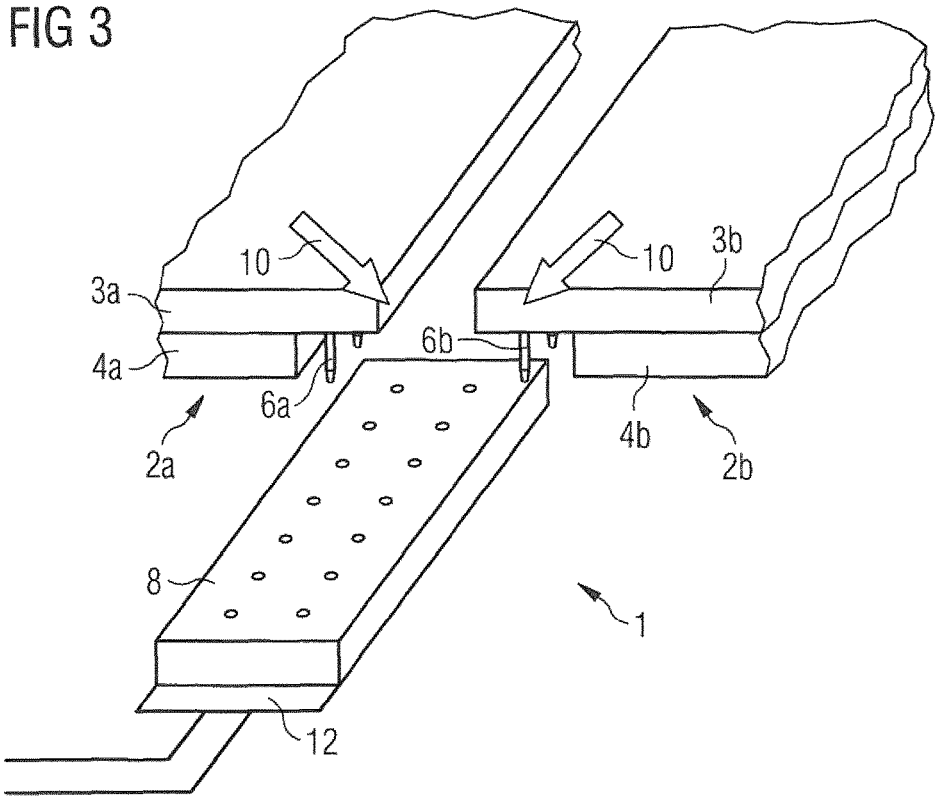
FIG. 3 shows a schematic illustration of an illuminant in accordance with a further embodiment.

FIG. 3 shows an embodiment of an illuminant 1 in the form of a light-emitting module, in which the illuminant 1 likewise has two light-emitting element units 2*a*, 2*b*, wherein each light-emitting element unit 2*a*, 2*b* has in each case one carrier element 3*a*, 3*b*, a light-emitting semiconductor element surrounded by an encapsulating material 4*a*, 4*b* and a contact area. In each case one contact element 6*a*, 6*b* in the form of a male connector element is arranged on the contact areas. The mating contact element 8 is in this case in the form of a female connector element and is arranged on a carrier plate 12 in the form of a printed circuit board. The two contact elements 6*a*, 6*b* can be arranged or plugged in next to one another on the mating contact element 8 so that, in this case too, two light-emitting element units 2*a*, 2*b* are connectable to one another via a mating contact element 8.

Figure 4:
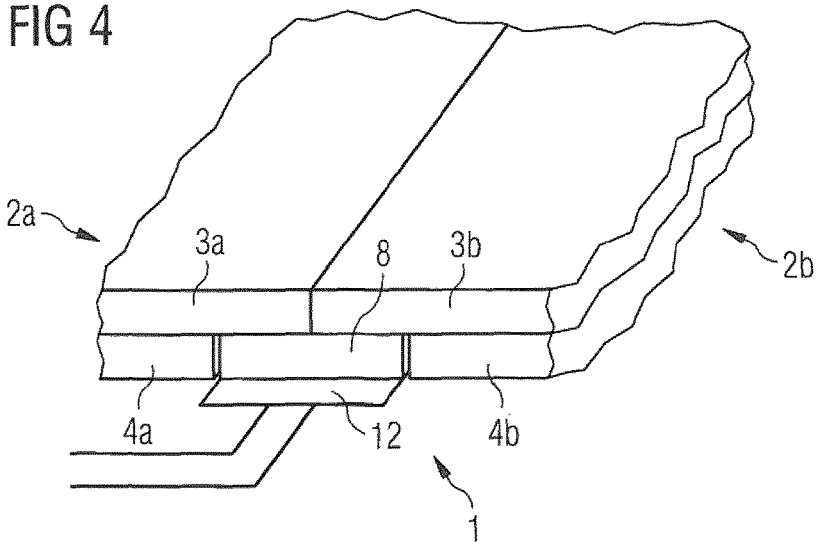
FIG. 4 shows a further schematic illustration of the embodiment of an illuminant shown in FIG. 3.

FIG. 4 shows the embodiment shown in FIG. 3 in a state in which the contact elements 6*a*, 6*b* of the light-emitting element units 2*a*, 2*b* are plugged together with the mating contact element 8, wherein, by arranging the light-emitting element units 2*a*, 2*b* and the mating contact element 8 directly next to one another, a particularly compact formation of an illuminant 1 is achieved.

Figure 5:
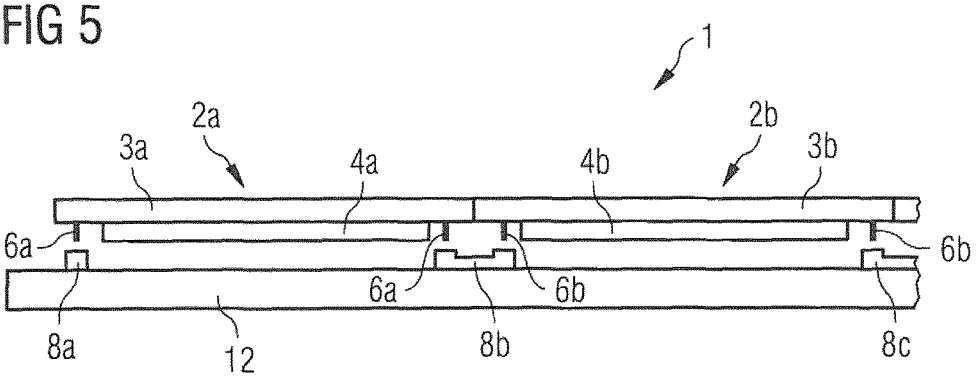
FIG. 5 shows a schematic illustration of an illuminant in accordance with a further embodiment.

FIG. 5 shows an embodiment which is similar to the embodiment shown in FIG. 3 and FIG. 4, wherein in this case a plurality of, in particular three, mating contact elements 8*a*, 8*b*, 8*c* are arranged on the carrier plate 12 and the light-emitting element units 2*a*, 2*b* each have two contact elements 6*a*, 6*b*. The mating contact element 8*b* arranged centrally between the two light-emitting element units 2*a*, 2*b*, said mating contact element being in the form of a female connector element, has, as is also provided in the embodiment shown in FIG. 4, two parallel rows of openings, wherein the pin contacts of the contact element 6*a* of the first light-emitting element unit 2*a* can be plugged into the first row of openings and the pin contacts of the contact element 6*b* of the second light-emitting element unit 2*b* can be plugged into the second row of openings in order to form an electrical contact. The mating contact elements 8*a*, 8*c* which are arranged to the right and left of the centrally arranged mating contact element 8*b* and are likewise in the form of female connector elements, each have only one row of openings, wherein pin contact elements of a further contact element 6*a* of the first light-emitting element unit 2*a* can be plugged into the openings in the mating contact element 8*a* and pin contact elements of a further contact element 6*b* of the second light-emitting element unit 2*b* can be plugged into the openings in the mating contact element 8*b* in order to form an electrical contact. In this embodiment, an illuminant can be formed from a plurality of light-emitting element units 2*a*, 2*b* combined to form a block.

Figure 6:
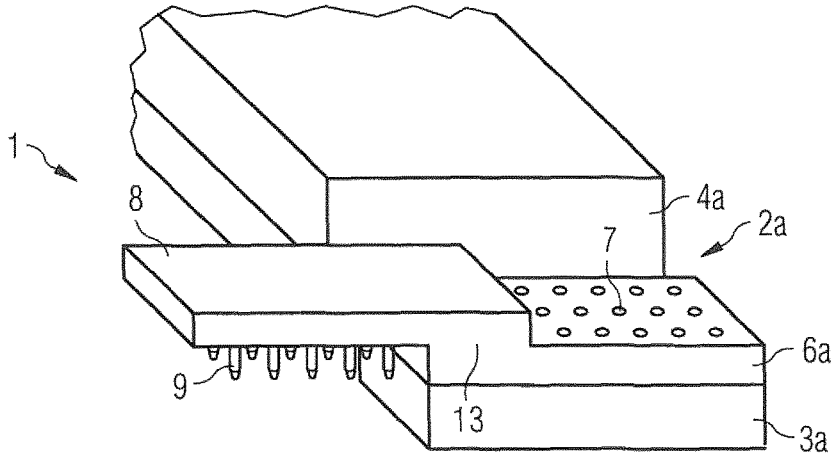
FIG. 6 shows a schematic illustration of an illuminant in accordance with a further embodiment.

FIG. 6 furthermore shows an embodiment of an illuminant in the form of a light-emitting panel, in which a contact element 6*a* of a first light-emitting element unit 2*a* is integrally connected, via a connecting region 13, to a mating contact element 8, which can be brought into electrical contact with a contact element of a second light-emitting element unit (not shown here), which can be arranged adjacent to the first light-emitting element unit 2*a*. The contact element 6*a* is in this case in the form of a female connector element and the mating contact element 8 is in the form of a male connector element, wherein the openings 7 in the female connector element of the contact element 6*a* are directed in the opposite direction to the pin contacts 9 of the mating contact element 8. The contact element 6*a* formed integrally with the mating contact element 8 forms a step shape or a Z shape. In this embodiment, two light-emitting element units which are arranged directly next to one another can be electrically connected to one another.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illuminant comprising:

at least two light-emitting element units, each of said units being a singular unitary body having a carrier, at least one light-emitting element, which is arranged on a surface of the carrier and is surrounded by an encapsulating material, the first unit having at least one first contact area formed on the surface of the carrier and a first contact element arranged on the first contact areas, wherein the light-emitting element surrounded by the encapsulating material is electrically connected to the first contact element via the first contact area, the second unit having at least one second contact area formed on the surface of the carrier and a second contact element arranged on each of the second contact areas, wherein the second light-emitting element surrounded by the encapsulating material is electrically connected to the second contact element via the second contact area;

wherein the at least two light-emitting units are arranged next to one another on a plane, and a mating contact element which is arranged on a carrier plate;

the carrier plate being positioned on a plane substantially parallel to each of the said units;

wherein the carrier plate connectively links each unit to at least one other unit;

wherein electrical contact is made between the mating contact element and the first and second contact element via a plug-type connection, wherein the first and second contact element is a female connector element in the form of a female connector strip, and the mating contact element is a male connector element in the form of a male connector strip from which a plurality of pin contact elements protrude, or the first and second contact element is a male connector element in the form of a male connector strip from which a plurality of pin contact elements protrude, and the mating contact element is a female connector element in the form of a female connector strip.

2. The illuminant as claimed in claim 1, wherein the at least one light-emitting element surrounded by an encapsulating material has at least one light-emitting semiconductor element.

3. The illuminant as claimed in claim 1, wherein the first and second contact element is electrically connected to the first and second contact area directly via a cohesive connection.

4. The illuminant as claimed in claim 1, wherein the first and second contact element is electrically connected to the first and second contact area via a printed circuit board.

5. The illuminant as claimed in claim 4, wherein the printed circuit board is a flexible printed circuit board.

6. The illuminant as claimed in claim 1, wherein the mating contact element is latchable detachably on the first and second contact element via at least one fastening element.

7. The illuminant as claimed in claim 1, wherein a mating contact element makes electrical contact with two or more first and second contact elements.

8. The illuminant as claimed in claim 1, wherein a plurality of mating contact elements are fastened on the carrier plate, and the plurality of mating contact elements are brought into electrical contact with a plurality of first and second contact elements.

9. The illuminant as claimed in claim 1, wherein a contact element of a first light-emitting element unit is integrally connected to a mating contact element, which is brought into electrical contact with the second contact element of a second light-emitting element unit, via a connecting region.

10. The illuminant as claimed in claim 9, wherein the first and second contact element and the integrally connected mating contact element form a step shape or a "Z" shape.

11. The illuminant as claimed in claim 9, wherein the first and second contact element is a female connector element and the integrally connected mating contact element is a male connector element or the first and second contact element is a male connector element and the integrally connected mating contact element is a female connector element wherein the female connector element has openings which are directed in the opposite direction to the pin contact elements of the male connector element.

12. The illuminant as claimed in claim 1, wherein the mating contact element is connected to a power supply line.

13. The illuminant as claimed in claim 1, wherein the at least one first and second contact area and the at least one first and second contact element are arranged on the same side of the carrier as the at least one light emitting element surrounded by the encapsulating material.

14. The illuminant as claimed in claim 1, wherein the at least one first and second contact area and the at least one first and second contact element are arranged on the carrier adjacent to the at least one light emitting element surrounded by the encapsulating material.

15. The illuminant as claimed in claim 1, wherein the plug-type connection between the first and second contact element and the mating contact element is such that the first and second contact element and the mating contact element may be mechanically and/or electrically connected, disconnected and vice versa a plurality of times.

16. The illuminant as claimed in claim 1, wherein the at least one first and second contact area is an electrical contact area, the at least one first and second contact element is an electrical contact element and the mating contact element is a mating electrical contact element.

17. The illuminant as claimed in claim 1, wherein the at least one first and second contact area is formed on the same surface of the carrier as the light-emitting element and adjacent to the light-emitting element in a lateral direction.

18. The illuminant as claimed in claim 1, wherein the plug-type connection is such that the electrical contact between the mating contact and the first and second contact element is achieved as soon as the pin contact elements of the male connector element are completely plugged into the female connector element.

19. The illuminant as claimed in claim 1, wherein the at least two units and the mating contact element are arranged directly next to one another.

20. An illuminant comprising:

at least two light-emitting element units, each of said units being a singular unitary body having a carrier, at least one light-emitting element, which is arranged on a surface of the carrier and is surrounded by an encapsulating material, the first unit having at least one first contact area formed on the surface of the carrier and a first contact element arranged on the first contact areas, wherein the light-emitting element surrounded by the encapsulating material is electrically connected to the first contact element via the first contact area, the second unit having at least one second contact area formed on the surface of the carrier and a second contact element arranged on each of the second contact areas, wherein the second light-emitting element surrounded by the encapsulating material is electrically connected to the second contact element via the second contact area;

a mating contact element which is arranged on a carrier plate;

the carrier plate being positioned on a plane substantially parallel to each of the said units;

wherein the first contact element of the first light-emitting element unit is integrally connected to the mating contact element, which is brought into electrical contact with the second contact element of the second light-emitting element unit, via a connecting region;

wherein the first and second contact element and the integrally connected mating contact element form a step shape or a "Z" shape;

wherein the carrier plate connectively links each unit to at least one other unit;

wherein electrical contact is made between the mating contact element and the first and second contact element via a plug-type connection, wherein the first and second contact element is a female connector element in the form of a female connector strip, and the mating contact element is a male connector element in the form of a male connector strip from which a plurality of pin contact elements protrude, or the first and second contact element is a male connector element in the form of a male connector strip from which a plurality of pin contact elements protrude, and the mating contact element is a female connector element in the form of a female connector strip;

wherein a plurality of openings in the female connector strip is directed in the opposite direction to each the plurality of pin contact elements in the male connector strip.

* * * * *